United States Patent [19]

Simon

[11] Patent Number: 4,479,777

[45] Date of Patent: Oct. 30, 1984

[54] HEADER BRICK IN REGENERATOR LATTICE STRUCTURE

[75] Inventor: Günter Simon, Wiesbaden, Fed. Rep. of Germany

[73] Assignee: Didier-Werke AG, Wiesbaden, Fed. Rep. of Germany

[21] Appl. No.: 454,182

[22] Filed: Dec. 27, 1982

[30] Foreign Application Priority Data

Mar. 30, 1982 [DE] Fed. Rep. of Germany ..... 3211624

[51] Int. Cl.[3] ..... F27D 17/00; F23L 15/02

[52] U.S. Cl. ..... 432/179; 432/180; 110/338; 165/9.1; 165/9.4

[58] Field of Search ..... 110/336, 338; 165/9.1–9.4; 202/267 R; 264/30; 432/179–182

[56] References Cited

U.S. PATENT DOCUMENTS

| | | | |
|---|---|---|---|
| 1,703,793 | 2/1929 | Stein | 165/9.4 |
| 1,766,283 | 6/1930 | Danforth, Jr. et al. . | |
| 2,176,157 | 10/1939 | Tanner | 165/9.1 |
| 2,962,131 | 10/1954 | Hasche | 165/9.1 |

FOREIGN PATENT DOCUMENTS

| | | | |
|---|---|---|---|
| 203478 | 10/1908 | Fed. Rep. of Germany . | |
| 831390 | 9/1938 | France . | |
| 85889 | 3/1936 | Sweden | 165/9.2 |
| 130479 | 8/1919 | United Kingdom | 165/9.2 |
| 610161 | 10/1948 | United Kingdom | 165/9.2 |

*Primary Examiner*—Henry C. Yuen

*Attorney, Agent, or Firm*—Wenderoth, Lind & Ponack

[57] ABSTRACT

A freely diagonally staggered regenerator lattice structure includes successive courses of rows of rectangular runner bricks and courses of rows of rectangular header bricks. Each header brick has formed in opposite side surfaces thereof recesses extending from a lower surface thereof to an upper surface thereof. The height of each header brick is 55 to 60% of the sum of the height of header brick and the height of a runner brick. The height of each runner brick is 40 to 45% of such sum. The header bricks of upper courses may have end projections which fit into recesses in the runner bricks of the next lower course of runner bricks.

11 Claims, 5 Drawing Figures

HEADER BRICK IN REGENERATOR LATTICE STRUCTURE

BACKGROUND OF THE INVENTION

The present invention relates to a freely diagonally staggered regenerator lattice structure of the type including successive courses of rows of rectangular runner bricks and courses of rows of rectangular header bricks, and to an improved header brick employable in such structure.

For regenerations of glass-trough furnaces or "Siemens-Martin" furnaces, the fireproof interior lining of regenerator chambers includes a lattice structure which is formed by courses of rows of bricks. The rows of bricks are formed by rectangular bricks which rest on bearing surfaces. With a freely diagonally staggered lattice structure, there occur alternating courses of stretcher or runner bricks and header bricks, followed by a course of grate supporting bricks. The runner bricks adjoin at respective adjacent end surfaces and form continuous rows which generally run in the longitudinal direction of the chamber. The header bricks always extend between and connect two rows of runner bricks and are spaced in the direction of the rows of runner bricks by a pitch or axis measurement a. The axis measurement a is the sum of the distance between two adjacent header bricks and the width of one header brick. The rows of header bricks extend at right angles to the direction of the rows of runner bricks, and the rows of header bricks are displaced with respect to each other in a staggered manner by one-half of the axis measurement. Vertical conduits are formed in the lattice structure by the header bricks and the runner bricks, and continuous horizontal flues are obtained in the courses of runner bricks. In addition, the lattice structure includes edge stones provided between the header bricks on the outer rows of runner bricks. In the upper courses or layers, filling bricks can be inserted between the runner bricks on top of the header bricks. The freely diagonally staggered lattice structure offers high stability and the possibility of changing the conduit measurements with a constant brick or stone format.

SUMMARY OF THE INVENTION

With the above discussion in mind, it is the object of the present invention to provide an improved freely diagonally staggered regenerator lattice structure and an improved header brick employable therein, by which it is possible to obtain a greater number of vertical conduits and a larger heating surface ($m^2$) per $m^3$ of the lattice structure.

This object is achieved in accordance with the present invention by the provision that each header brick has formed in opposite side surfaces thereof recesses extending from a lower surface thereof to an upper surface thereof. The height of each header brick is 55 to 60% of the sum of the height of the header brick and the height of a runner brick. The height of each runner brick is 40 to 45% of such sum. The recesses in the header bricks make it possible to reduce the axis measurement in the lattice structure with a constant conduit cross section and thus to increase the number of conduits. Therefore, and in view of the fact that the number of courses of header bricks is relatively high, there results a surprising increase of the heating surface of the lattice structure. The stability of the lattice structure is preserved by the provision of successive courses of header bricks and runner bricks with varied height.

In accordance with an advantageous feature of the present invention, in the area of the header brick between the recesses in the opposite side surfaces thereof, the width of the header brick is reduced by 20 to 40%. This reduction does not reduce the stability of the header brick such that it is unacceptable, nor does it reduce the stability of the lattice structure. To reduce the width in the area of the recesses by less than 20% would result in only a small increase in the number of conduits, and to reduce the width by more than 40% would reduce the mechanical stability and storage capacity of the header brick.

In accordance with a specifically preferred embodiment of the present invention, each recess is at least partially formed by a plurality of grooves, that is the recesses have grooves. Such grooves extend between the upper and lower surfaces of the header brick. The cross-sectional configuration of the grooves can be circular, or the grooves can have rounded edges, such that the contour of the grooves in the recesses is generally in the form of a sine wave. The ratio of the length of the surface of each recess to the linear length of the region occupied by the recess is 1.10:1 to 1.30:1. The header bricks of vertically adjacent courses are staggered such that the grooves thereof are not in vertical alignment. In other words, when building the lattice structure, the sides of the header bricks are alternated in successive courses which are separated by courses of runner bricks. This succession of uneven side areas of the header bricks, placed one above the other in a vertical column, increases the gas flow turbulance and/or the air flow turbulance in the conduits.

In order to counteract possible twisting and dislocation of bricks in the upper courses, which frequently occurs in practical operation of known regenerator lattice structures, it is contemplated to provide that each header brick, at least in the upper courses of the header bricks, has recesses formed in the lower surface thereof at opposite ends thereof, thereby forming end projections placed on top of the runner bricks of the next lower course of runner bricks. Additionally, the runner bricks, at least in the upper courses of runner bricks, may have recesses formed in the upper surfaces thereof, the end projections of the header bricks fitting into respective runner brick recesses. The depth of the runner brick recesses preferably is from 10 to 15% of the total height of the header bricks and the runner bricks. By this arrangement, the lower surface of the header bricks come to within a narrow gap of the header bricks of the next lower course of header bricks without actually contacting them. Thus, in the upper area of the lattice structure, for example the third to eighth courses thereof, the header bricks also fulfill the function of previously used filler bricks between runner bricks. As a result of this arrangement, the runner bricks also are secured against displacement.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
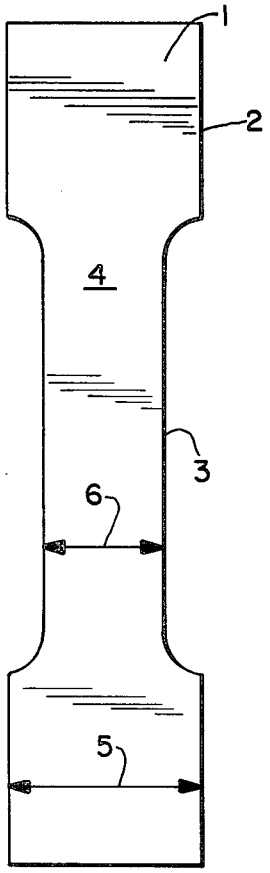
FIG. 1 is a plan view of a header brick having recesses in opposite side surfaces thereof in accordance with one embodiment of the present invention.

Illustrated in FIG. 1 is an upper bearing surface 4 of a header brick 1 in accordance with one embodiment of the present invention. Header brick 1 has a lower, non-illustrated bearing surface similar to upper bearing surface 4. In opposite side surfaces 2 of header brick 1 are formed respective recesses 3 extending entirely between the upper and lower bearing surfaces of the brick. In the area of the header brick between recesses 3 and opposite side surfaces 2, the reduced width 6 of the header brick is reduced by 20 to 40% compared with the overall width 5 of the brick, and in the specifically illustrated example, the reduction in width is approximately 36%.

Figure 2:
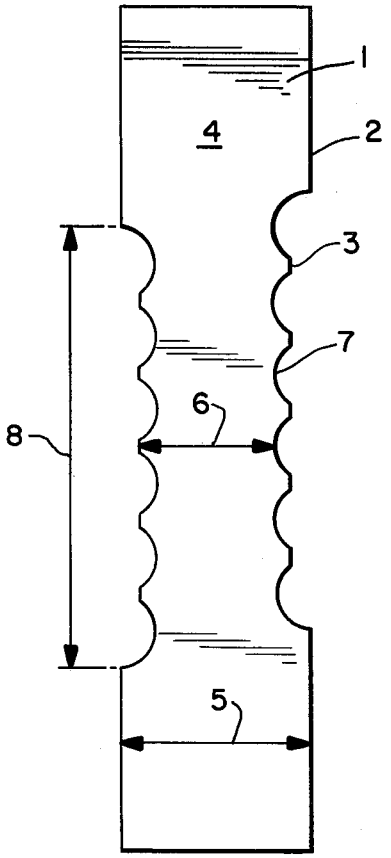
FIG. 2 is a view similar to FIG. 1 but of a further embodiment of the present invention.

In FIG. 2 is illustrated a header brick 1 according to a second embodiment of the present invention. This embodiment is similar to that of FIG. 1, with the exception that the recesses 3 are at least partially formed by grooves 7, which in this example have a partial circular cross-sectional configuration. Thus, as shown in FIG. 2, laterally outermost surfaces of brick 1, in the area of each recess 3, are located inwardly of the plane of the respective side surface 2. Grooves 7 extend the entire height of the recesses. Furthermore, as illustrated, the grooves of one recess 3 are displaced with respect to the grooves of the other recess 3 by an amount equal to one-half of the width of groove 7. In this embodiment of the invention, the ratio of the total length of the surface of each recess to the linear length 8 of the region occupied by the recess is 1.10:1 to 1.30:1, and in the specifically illustrated example approximately 1.21:1.

Figure 3:
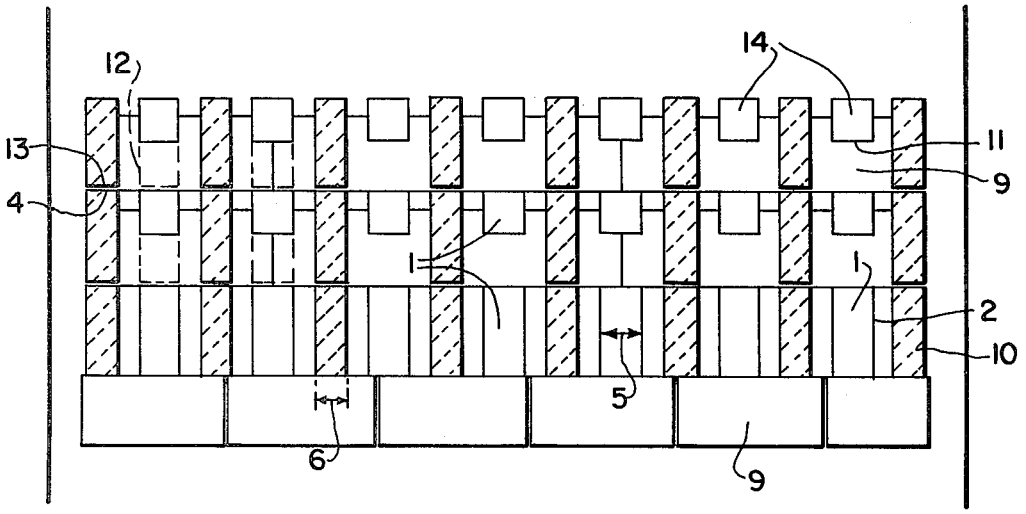
FIG. 3 is a vertical cross-section through a lattice structure according to the present invention.

FIG. 3 illustrates a lattice structure formed by a bottom course of rows of stretcher or runner bricks 9 having thereon a course of rows of header bricks 1, followed alternately by courses of rows of runner and header bricks. In total, three courses of rows of runner bricks and three courses of rows of header bricks are illustrated in FIG. 3. It of course is to be understood that a given lattice structure might be formed of any desirable number of additional alternate courses of rows of runner and header bricks. Furthermore, in the illustrated arrangement, the upper two courses of header bricks fit into recesses formed in the upper two courses of runner bricks. The section of FIG. 3 illustrates the sectional edges 10 of the header bricks 1 according to the present invention having a reduced width 6 compared to the width 5 on the visible frontal surfaces of staggered rows of header bricks. The height of the header bricks is greater than the height of the runner bricks, and in the illustrated arrangement, the height of the header bricks is approximately 55% of the sum of the height of the header bricks and the height of the runner bricks. In the upper two courses of header bricks, the header bricks have end projections 14 fitting in respective recesses 11 of the runner bricks 9. That part of the sides 2 of the header bricks which extends downwardly beyond the projections 14 and is actually concealed behind respective runner bricks is illustrated in some positions in FIG. 3 by dotted lines 12. Lower surfaces 13 of the header bricks which fit into recesses in the next lower runner bricks 9 project downwardly and are spaced only by a slight gap from the top surface 4 of the next lower course of header bricks. Accordingly, in the upper courses of the regenerator lattice structure, the header bricks themselves perform the function of previously employed filler bricks. On the top bearing surfaces 4 of the header bricks rest the rows of the runner bricks for the next higher course of runner bricks. The top of the regenerator lattice structure is finished off with a course of header bricks.

Figure 4:
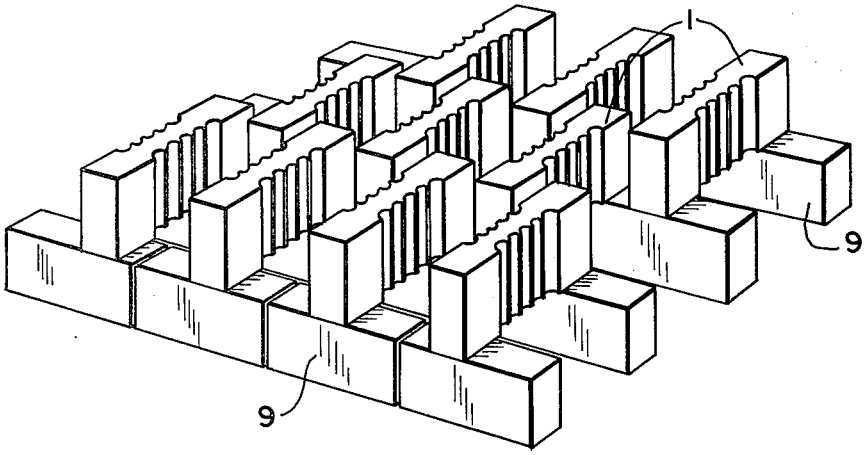
FIG. 4 is a perspective view of one course of rows of runner bricks having arranged thereabove one course of rows of header bricks.

FIG. 4 illustrates somewhat more clearly the relationship between the bottom course of runner bricks 9 and the bottom course of header bricks 1 as illustrated in FIG. 3, with the additional provision that FIG. 4 illustrates the use of header bricks as shown in FIG. 2.

Figure 5:
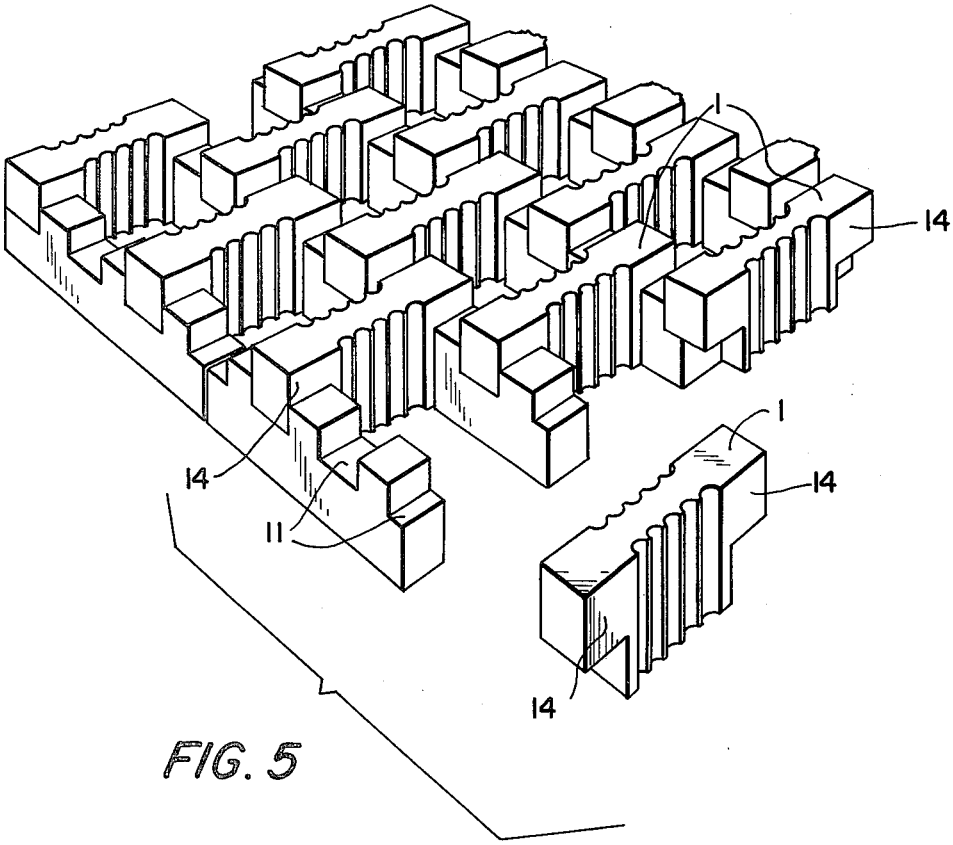
FIG. 5 is a view similar to FIG. 4 but showing end projections of the header fitting within respective recesses in the next lower course of runner bricks.

FIG. 5 is similar to FIG. 4 but illustrates the relationship between one of the upper courses of runner bricks and the next higher course of header bricks, as shown in FIG. 3. Specifically, in FIG. 5 it is illustrated how the header bricks 1 have recesses formed in the lower surfaces thereof at opposite ends thereof, thereby forming end projections 14 which fit into recesses 11 formed in the runner bricks of the next lower course of runner bricks.

It is believed that the structural features of the present invention readily are apparent from the illustrations of FIGS. 1–5.

The following table lists examples of a freely diagonally staggered regenerator lattice structure with courses of rectangular header bricks and rectangular runner bricks, and the table shows the improvements as a result of the features according to the present invention. In the table, examples 1 and 2 concern known lattice structures with rectangular bricks and equally high courses of rows of header bricks and rows of runner bricks. Proceeding from square conduits with a width of 140 mm, there are obtained twenty-four conduits/$m^2$ and 15.13 $m^2/m^3$ of heating surface with a brick width of 64 mm. According to example 2, a greater width for the conduits and the bricks will result in even lower values.

By a comparison of examples 3 to 5 with example 1, it is shown that the characteristic feature of a recess on the sides of the header bricks in accordance with the present invention results in a considerable increase in the number of conduits/$m^2$. The additional characteristic feature of the present invention of the relative heights of the courses of header bricks and courses of runner bricks, according to example 6, for which average values of the height of the courses and the width of the recesses (conduit width of 140 mm being unchanged), results in a heating surface of 16.04 $m^2/m^3$ and thus an increase of 6.0% compared to example 1. The further design improvement of installing grooves in the recesses, as shown in example 7, with otherwise unchanged measurements compared to example 6, increases the heating surface by 12.6% compared to example 1. The grooves have circular cross-sections, based on a circle with a radius of 12 mm. Examples 8 and 9 show that for the diagonally staggered regenerator lattice structure with header bricks which have recesses with grooves according to the present invention, the heating surface is increased by approximately 11.5 to 14%.

In the case of a lattice structure with square shaped conduits and a conduit width of 160 mm, it is possible to obtain a heating surface increase of 15.9% according to the invention, as illustrated by example 10, compared to example 2. Thus, there is obtained in accordance with the present invention a surprisingly high increase in the heating surface of the regenerator lattice structure, compared to comparable traditional diagonally staggered regenerator structures. This improvement is achieved in a very simple manner, without the use of bricks which deviate substantially from a rectangular shape and thereby are quite expensive.

| | | 1 | 2 | 3 | 4 | 5 | 6 | 7 | 8 | 9 | 10 |
|---|---|---|---|---|---|---|---|---|---|---|---|
| Course of header bricks | (length 278 mm) | | | | | | | | | | |
| Width | mm | 64 | 76 | 64 | 64 | 64 | 64 | 64 | 64 | 64 | 64 |
| Height/Height of course | % | | | | | | 57 | 57 | 55 | 60 | 57 |
| Height/Height of course | mm | 124 | 150 | | | | 150 | 150 | 145 | 158 | 150 |
| Recess header bricks | % | | | 20 | 30 | 40 | 30 | 30 | 20 | 40 | 30 |
| Recess header bricks | mm | | | 51 | 45 | 38 | 45 | 45 | 51 | 38 | 45 |
| Recess length | mm | | | | | | 120 | 120 | 120 | 120 | 144 |
| Grooves, ratio of length surface to linear length | | | | | | | | 1.22 | 1.22 | 1.22 | 1.21 |
| Runner brick | (length 230 mm) | | | | | | | | | | |
| Width | mm | 64 | 76 | | | | 64 | 64 | 64 | 64 | 64 |
| Height/Height of course | % | | | | | | 43 | 43 | 45 | 40 | 43 |
| Height/Height of course | mm | 124 | 150 | | | | 114 | 114 | 119 | 106 | 114 |
| Height for header bricks and runner bricks | mm | 248 | 300 | | | | 264 | 264 | 264 | 264 | 264 |
| Width of conduit | mm | 140 | 160 | 140 | 140 | 140 | 140 | 140 | 140 | 140 | 160 |
| Axis meas. ($a^1$) | mm | 204 | 236 | 191 | 185 | 178 | 185 | 185 | 191 | 178 | 205 |
| Axis meas. ($b^2$) | mm | 204 | 236 | 204 | 204 | 204 | 204 | 204 | 204 | 204 | 224 |
| Conduits/$m^2$ | | 24 | 18 | 25.7 | 26.5 | 27.5 | 26.5 | 26.5 | 25.7 | 27.5 | 21.8 |
| Heating surface | $m^2/m^3$ | 15.13 | 13.21 | | | | 16.04 | 17.03 | 16.87 | 17.24 | 15.31 |
| Increase in heating surface | % | | | | | | 6.0 | 12.6 | 11.5 | 14.0 | 15.9 |

[1]Width of conduits and reduced width in the area of the recesses in the header bricks.
[2]Width of conduits and width of runner bricks.

Although the present invention has been described and illustrated with regard to specifically preferred features, it is to be understood that various modifications and changes may be made without departing from the spirit and scope of the present invention.

I claim:

1. In a freely diagonally staggered regenerator lattice structure of the type including successive courses of rows of rectangular runner bricks and courses of rows of rectangular header bricks, the improvement wherein:

each said header brick has formed in opposite side surfaces thereof recesses extending from a lower surface thereof to an upper surface thereof, each said recess being at least partially formed by a plurality of grooves, such that laterally outermost surfaces of said brick in the area of each of said recess are located inwardly of the respective said side surface of said brick;

the height of each said header brick is 55 to 60% of the sum of the height of said header brick and the height of a said runner brick;

the height of each said runner is 40 to 45% of said sum; and the width of each said header brick, in the area thereof between said recesses in said opposite side surfaces thereof, is reduced by 20 to 40%.

2. The improvement claimed in claim 1, wherein said grooves extend between said upper and lower surfaces.

3. The improvement claimed in claim 1, wherein said grooves of one said recess are displaced with respect to said grooves in the other said recess by one-half of the width of said groove.

4. The improvement claimed in claim 3, wherein said header bricks of vertically adjacent said courses of header bricks are staggered such that said grooves thereof are not in vertical alignment.

5. The improvement claimed in claim 1, wherein each said groove has a partial circular cross-sectional configuration.

6. The improvement claimed in claim 1, wherein the ratio of the length of the surface of each said recess to the linear length of the region occupied by said recess is 1.10:1 to 1.30:1.

7. The improvement claimed in claim 1, wherein each said header brick, at least in upper said courses of said header bricks, has recesses formed in said lower surface thereof at opposite ends thereof, thereby forming end projections resting on the next lower said course of runner bricks.

8. The improvement claimed in claim 7, wherein said runner bricks, at least in upper said courses of said runner bricks, have recesses formed in the upper surfaces thereof, said end projections of said header bricks fitting in respective said runner brick recesses.

9. The improvement claimed in claim 8, wherein the depth of said runner brick recesses is 10 to 15% of the total height of said header bricks and said runner bricks.

10. The improvement claimed in claim 1, wherein opposite ends of each said header brick rest on and extend across the entire width of respective said runner bricks.

11. The improvement claimed in claim 10, wherein said runner bricks, at least in upper said courses of said runner bricks, have recesses formed in the upper surfaces thereof, said header bricks fitting in said runner brick recesses.

* * * * *